US010881234B2

(12) United States Patent
Roberts

(10) Patent No.: US 10,881,234 B2
(45) Date of Patent: Jan. 5, 2021

(54) SECURE MAIL AND PACKAGE STORAGE APPARATUS

(71) Applicant: Doyle Roberts, Columbia, SC (US)

(72) Inventor: Doyle Roberts, Columbia, SC (US)

( * ) Notice: Subject to any disclaimer, the term of this patent is extended or adjusted under 35 U.S.C. 154(b) by 84 days.

(21) Appl. No.: 16/413,262

(22) Filed: May 15, 2019

(65) Prior Publication Data

US 2020/0359819 A1 Nov. 19, 2020

(51) Int. Cl.

| | |
|---|---|
| ***A47G 29/14*** | (2006.01) |
| ***E05B 65/06*** | (2006.01) |
| ***E05F 1/12*** | (2006.01) |
| ***G07C 9/00*** | (2020.01) |
| ***E05C 7/04*** | (2006.01) |

(52) U.S. Cl.

CPC ..... *A47G 29/141* (2013.01); *E05B 65/06* (2013.01); *E05C 7/04* (2013.01); *E05F 1/12* (2013.01); *G07C 9/00571* (2013.01); *A47G 2029/145* (2013.01); *A47G 2029/148* (2013.01); *E05Y 2900/602* (2013.01)

(58) Field of Classification Search

CPC ..... A47G 29/141; A47G 2029/145; A47G 2029/148; E05B 65/06; E05F 1/12; G07C 9/00571; E05C 7/04; E05Y 2900/602

USPC ..... 700/231–244

See application file for complete search history.

(56) References Cited

U.S. PATENT DOCUMENTS

| | | | | |
|---|---|---|---|---|
| 5,223,829 | A * | 6/1993 | Watabe | A47G 29/141 235/382.5 |
| 5,386,462 | A * | 1/1995 | Schlamp | G07F 11/62 379/93.12 |
| 5,979,750 | A | 11/1999 | Kindell | |
| 6,533,167 | B2 | 3/2003 | Hassan | |
| 7,175,071 | B1 | 2/2007 | Slagle | |
| 7,246,738 | B2 | 7/2007 | Jonas | |
| 7,337,944 | B2 * | 3/2008 | Devar | A47G 29/141 232/19 |
| D707,015 | S | 6/2014 | Spencer | |
| 9,004,346 | B2 * | 4/2015 | Farentinos | A47G 29/22 232/43.3 |
| 9,327,887 | B2 | 5/2016 | Farentinos | |
| 9,830,572 | B2 * | 11/2017 | Wan | G06Q 10/0836 |
| 9,833,097 | B2 | 12/2017 | Byers | |
| 9,934,483 | B1 * | 4/2018 | Sangani | G06Q 10/0837 |
| 10,131,478 | B2 * | 11/2018 | Maser | B65D 25/14 |
| 2001/0045449 | A1 * | 11/2001 | Shannon | G07C 9/21 232/19 |
| 2006/0169762 | A1 * | 8/2006 | Irwin | E05G 7/001 232/45 |
| 2009/0166403 | A1 * | 7/2009 | Volpe | G07C 9/33 235/375 |
| 2013/0005487 | A1 * | 1/2013 | Frazzini | H04L 67/142 463/43 |

* cited by examiner

*Primary Examiner* — Michael Collins

(57) ABSTRACT

A secure mail and package storage apparatus for safely receiving mail includes a package housing that is secured to the ground and a lid coupled to the package housing that selectively closes a storage cavity. A lid lock locks and unlocks the lid. A CPU that is in operational communication with the lid lock has a transceiver that is configured to communicate with a smartphone. A mail tower with a mail door and a mail door lock is coupled to the package housing. A first keypad and a second keypod operate the lid lock and the door lock, respectively.

10 Claims, 7 Drawing Sheets

SECURE MAIL AND PACKAGE STORAGE APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to mailboxes and more particularly pertains to a new mailbox for safely receiving mail.

BRIEF SUMMARY OF THE INVENTION

An embodiment of the disclosure meets the needs presented above by generally comprising a package housing that has a housing front side separated from a housing back side, a housing left side separated from a housing right side, and a housing bottom side separated from an open housing top side defining a storage cavity. A plurality of ground screws is coupled to the package housing, and the plurality of ground screws is selectively engageable with the housing bottom side and is configured to secure the package housing to the ground. A lid is coupled to the package housing. The lid comprises a front half that is coupled to the housing top side adjacent the housing front side and a back half that is coupled to the housing top side adjacent the housing back side. Each of the front half and the back half has a hinge and is swingingly coupled to the package housing to move between a closed position sealing the storage cavity and an alternate open position exposing the storage cavity. A lid lock is coupled to the package housing. The lid lock is coupled to the housing left side and extends above the housing top side. The lid lock is in operational communication with the lid to lock the lid in the closed position and alternatively unlock the lid to allow it to move to the open position. A CPU is coupled to the package housing. The CPU is coupled to the housing right side adjacent the housing front side, and the CPU is in operational communication with the lid lock. A power source is coupled to the CPU and is in operational communication with the CPU. A transceiver is coupled to the CPU and is configured to communicate with a smartphone. A first keypad is coupled to the housing left side and is in operational communication with the CPU to lock and unlock the lid lock. A mail tower is coupled to the package housing and has a tower left side separated from a tower right side, a tower front side separated from a tower back side, and a tower bottom side separated from a tower top side. The tower front side has a mail cavity extending towards the tower back side. A mail door is coupled to the mail tower. The mail door is swingingly coupled to the tower front side to cover, and alternatively expose, the mail cavity. The mail door has a door lock that is in operational communication with the CPU. A second keypad is coupled to the mail tower. The second keypad is coupled to the tower front side below the mail cavity and is in operational communication with the CPU to lock and unlock the door lock.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
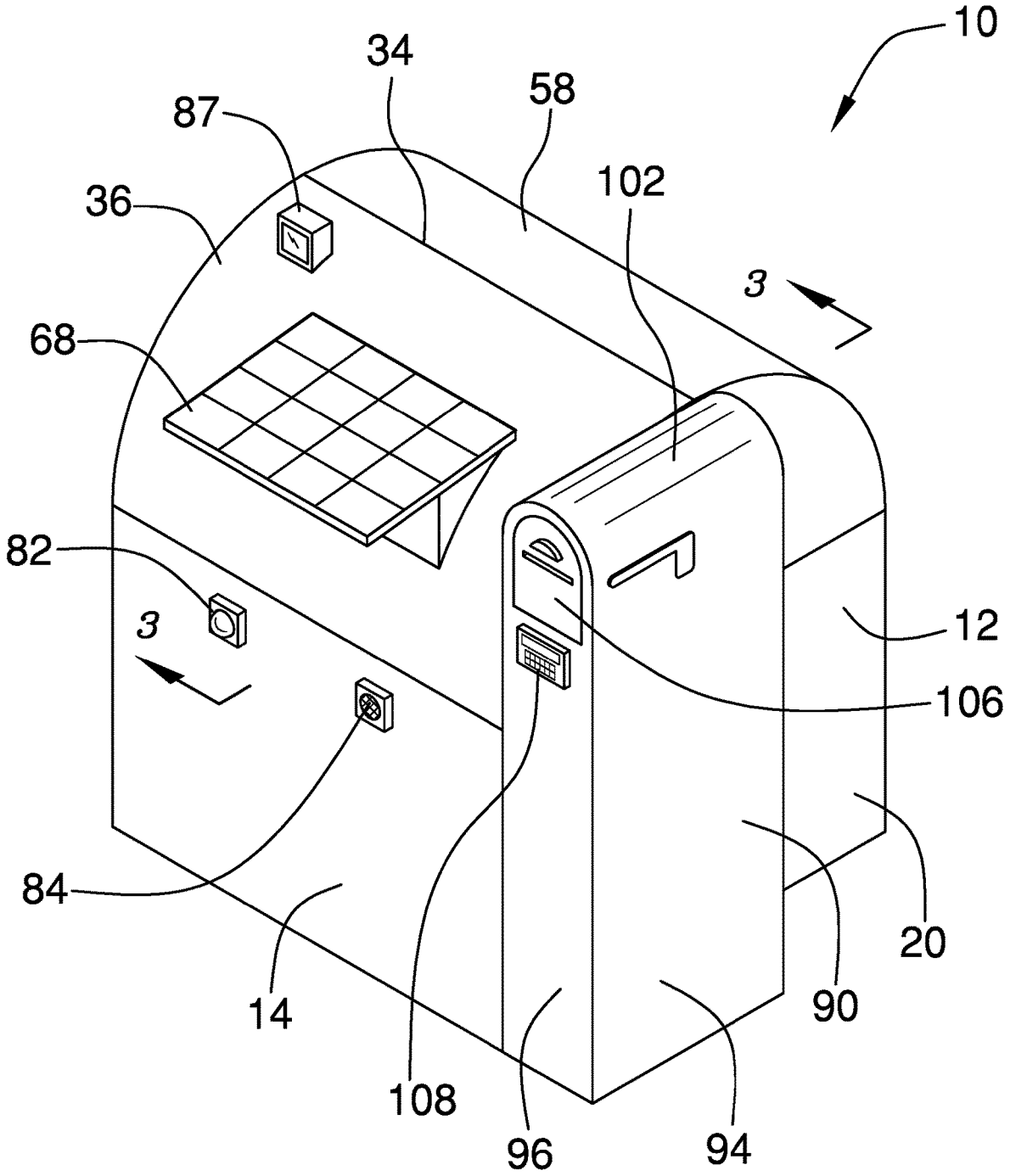
FIG. 1 is an isometric view of a secure mail and package storage apparatus according to an embodiment of the disclosure.
Figure 2:
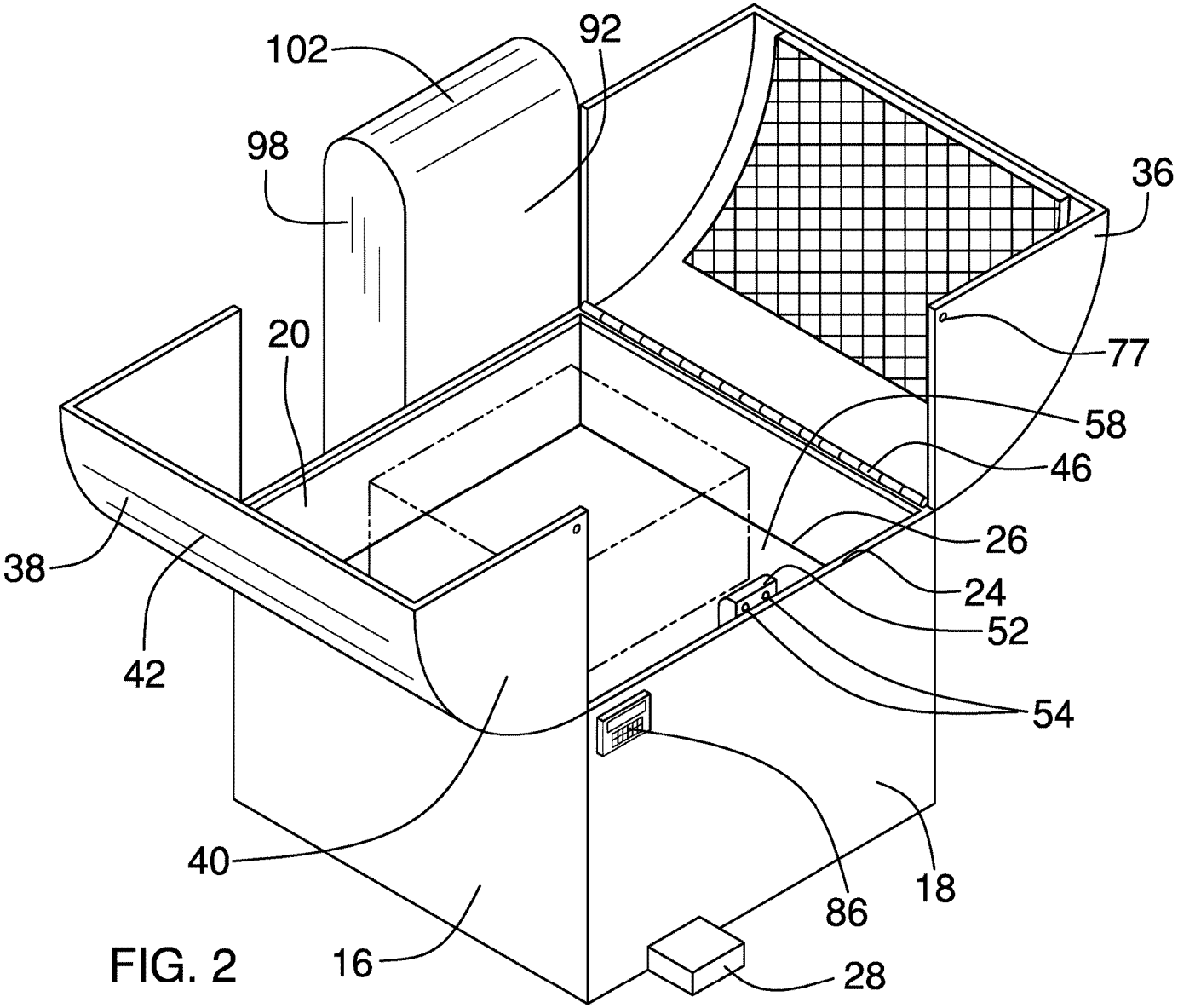
FIG. 2 is an isometric view of an embodiment of the disclosure.
Figure 3:
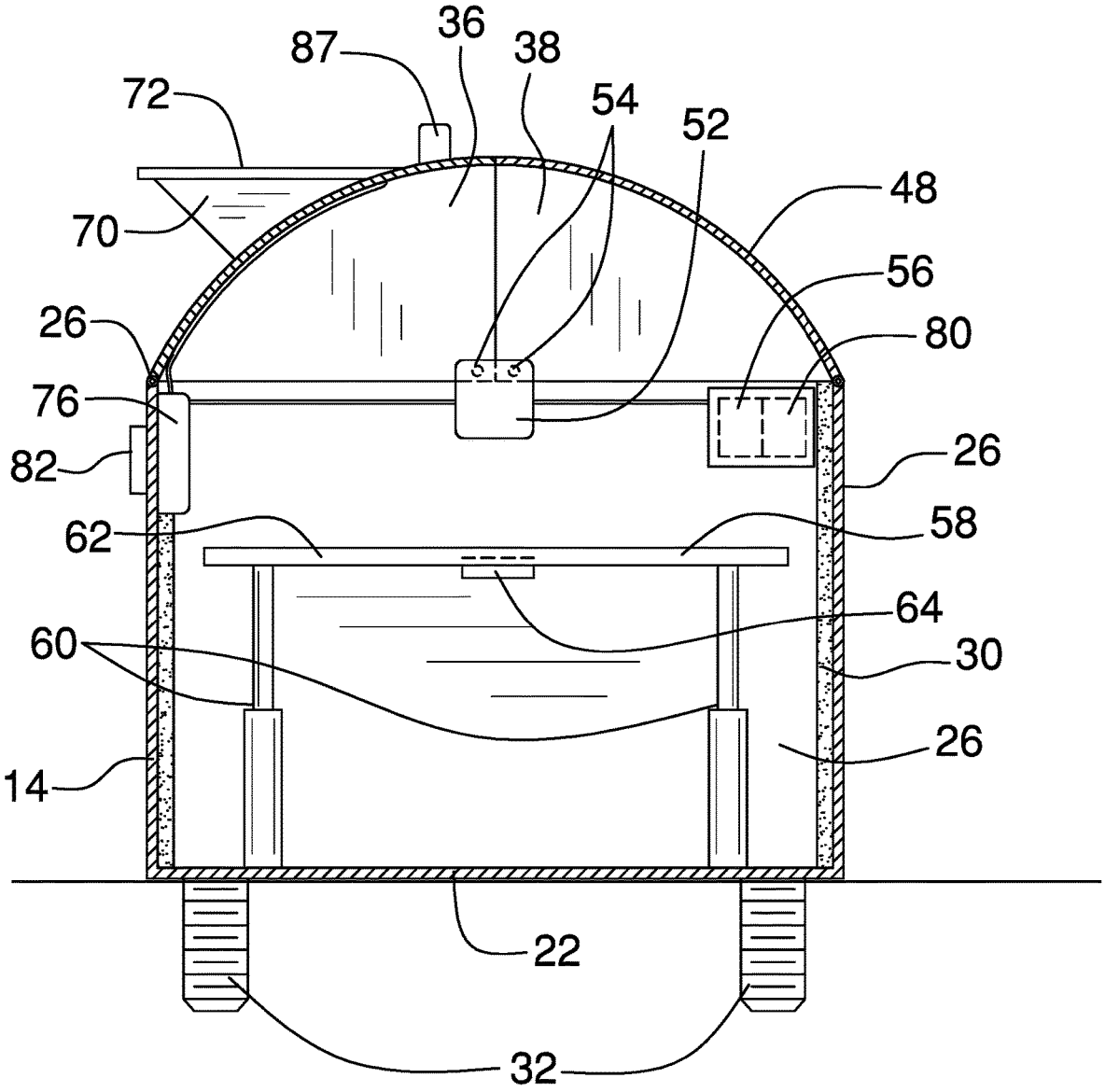
FIG. 3 is a cross sectional view along line 3-3 of FIG. 1 of an embodiment of the disclosure.
Figure 4:
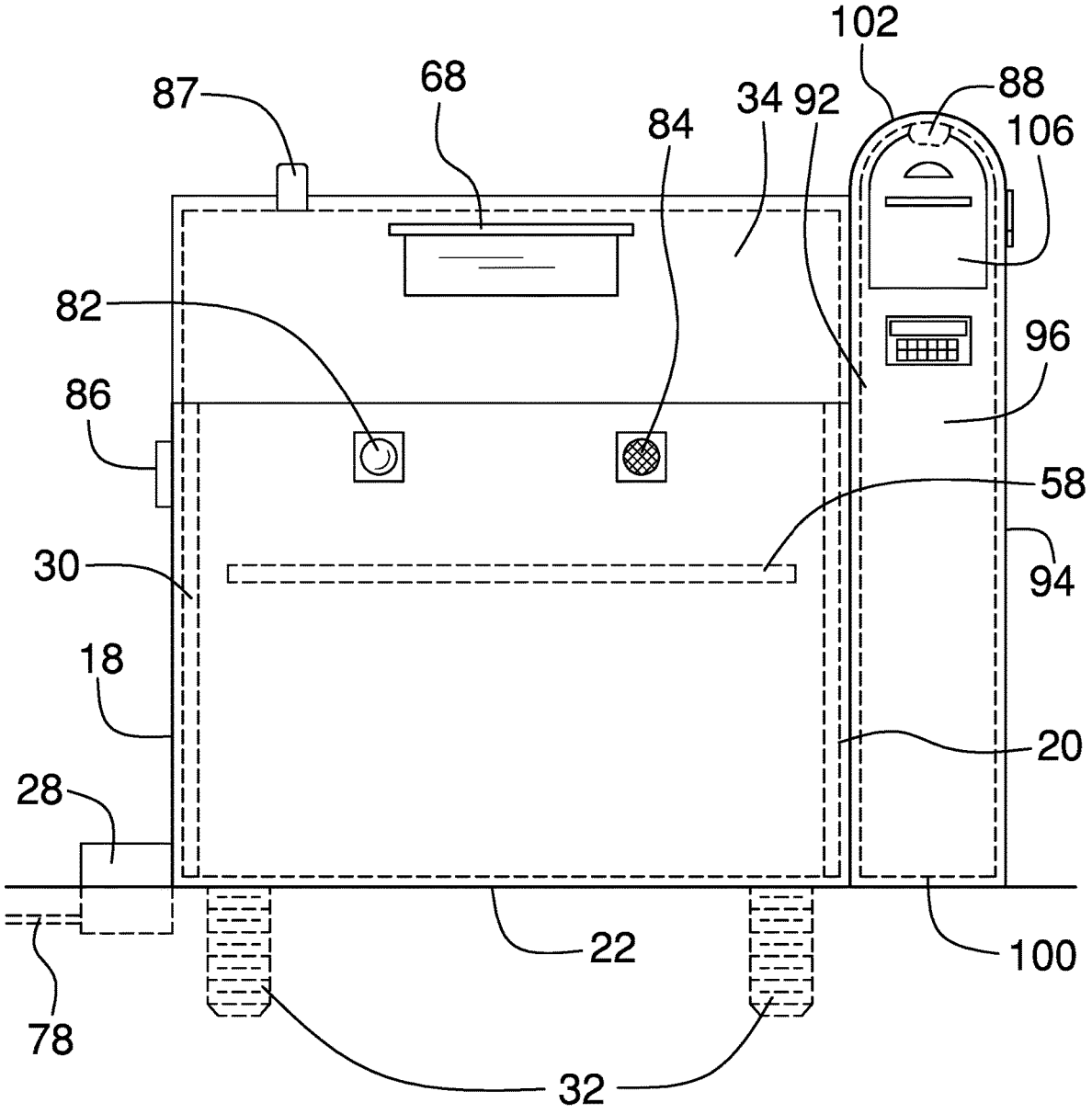
FIG. 4 is a front elevation view of an embodiment of the disclosure.
Figure 5:
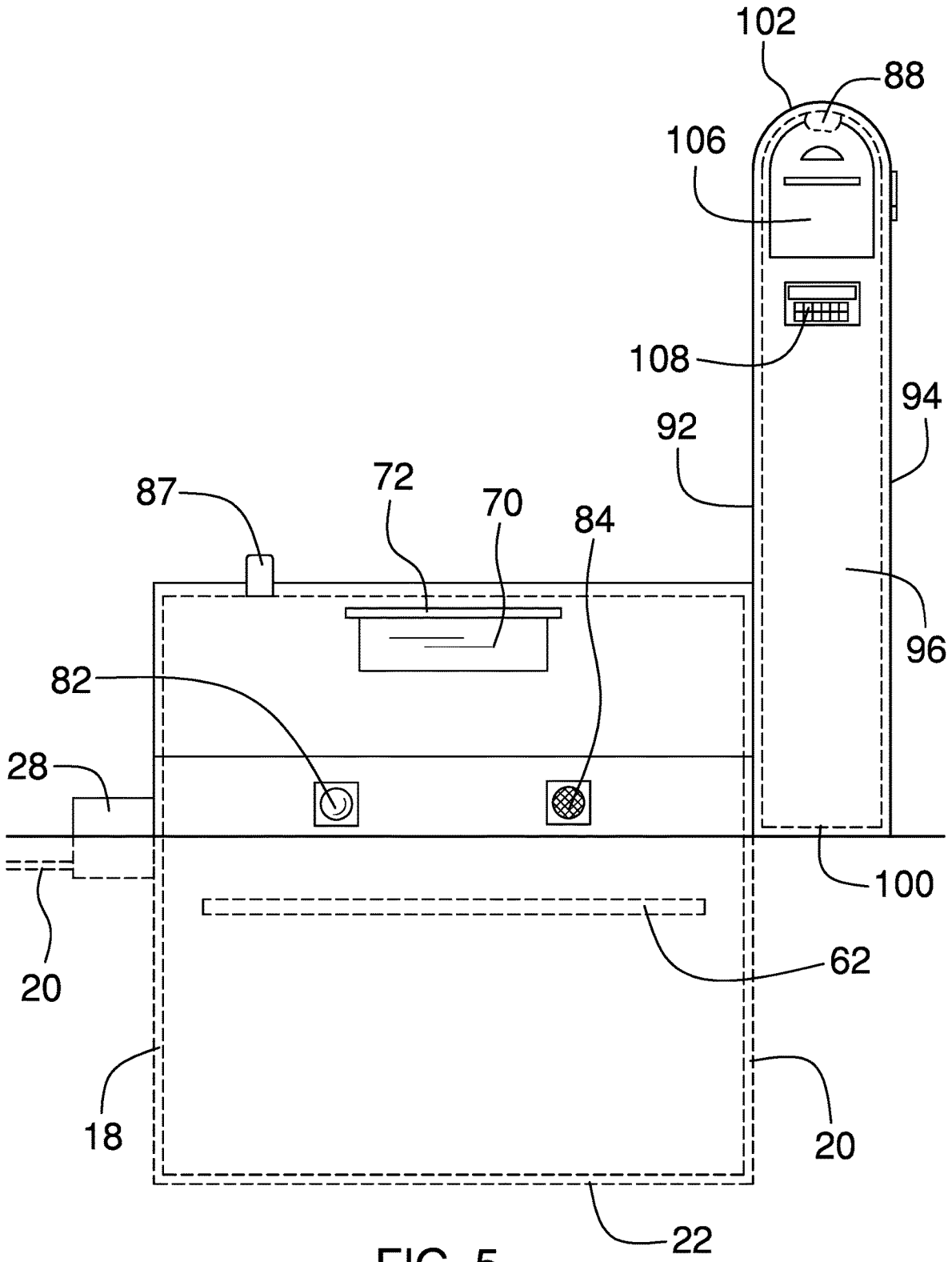
FIG. 5 is a front elevation view of an embodiment of the disclosure.
Figure 6:
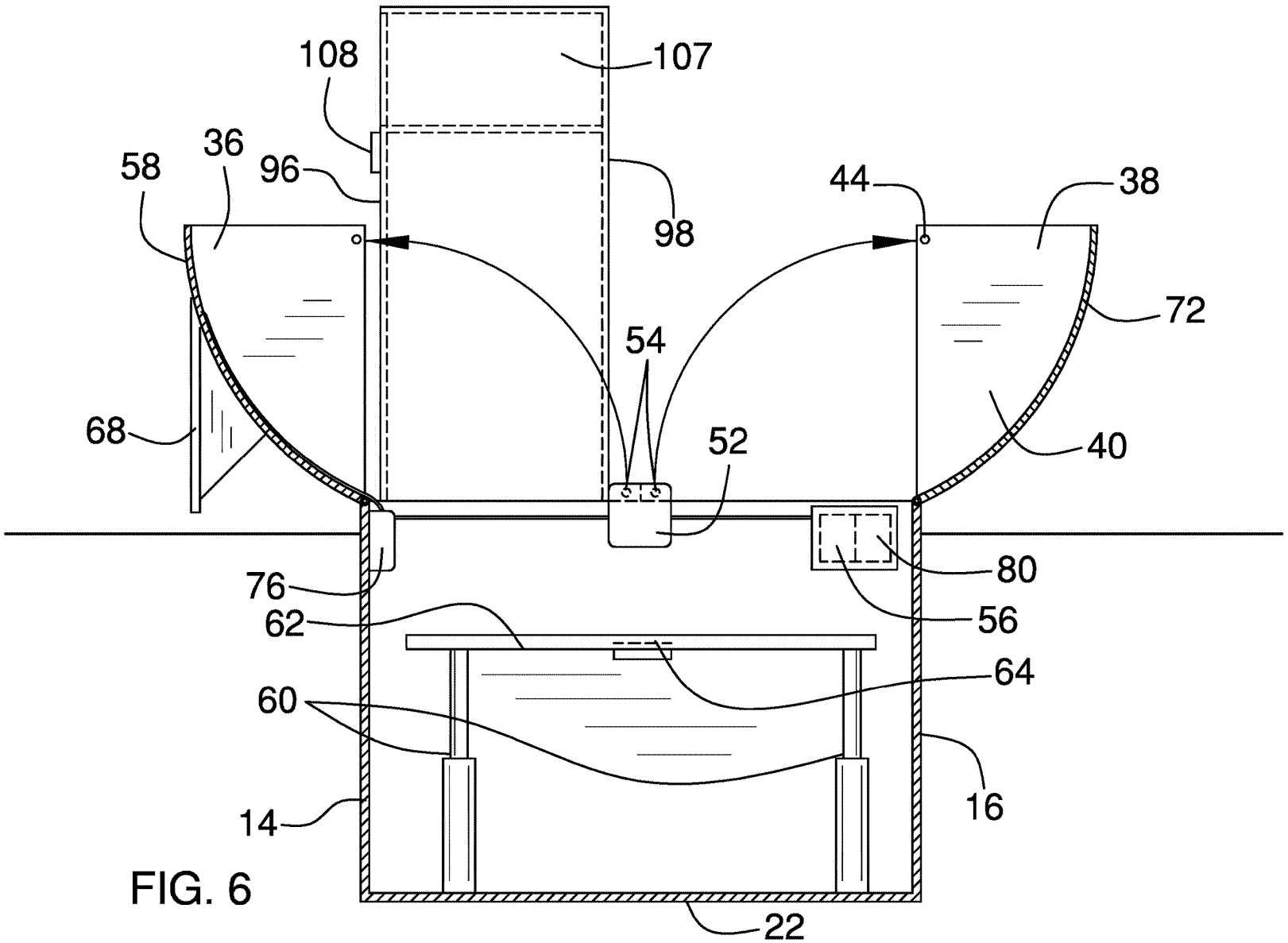
FIG. 6 is a cross-sectional view of an embodiment of the disclosure.
Figure 7:
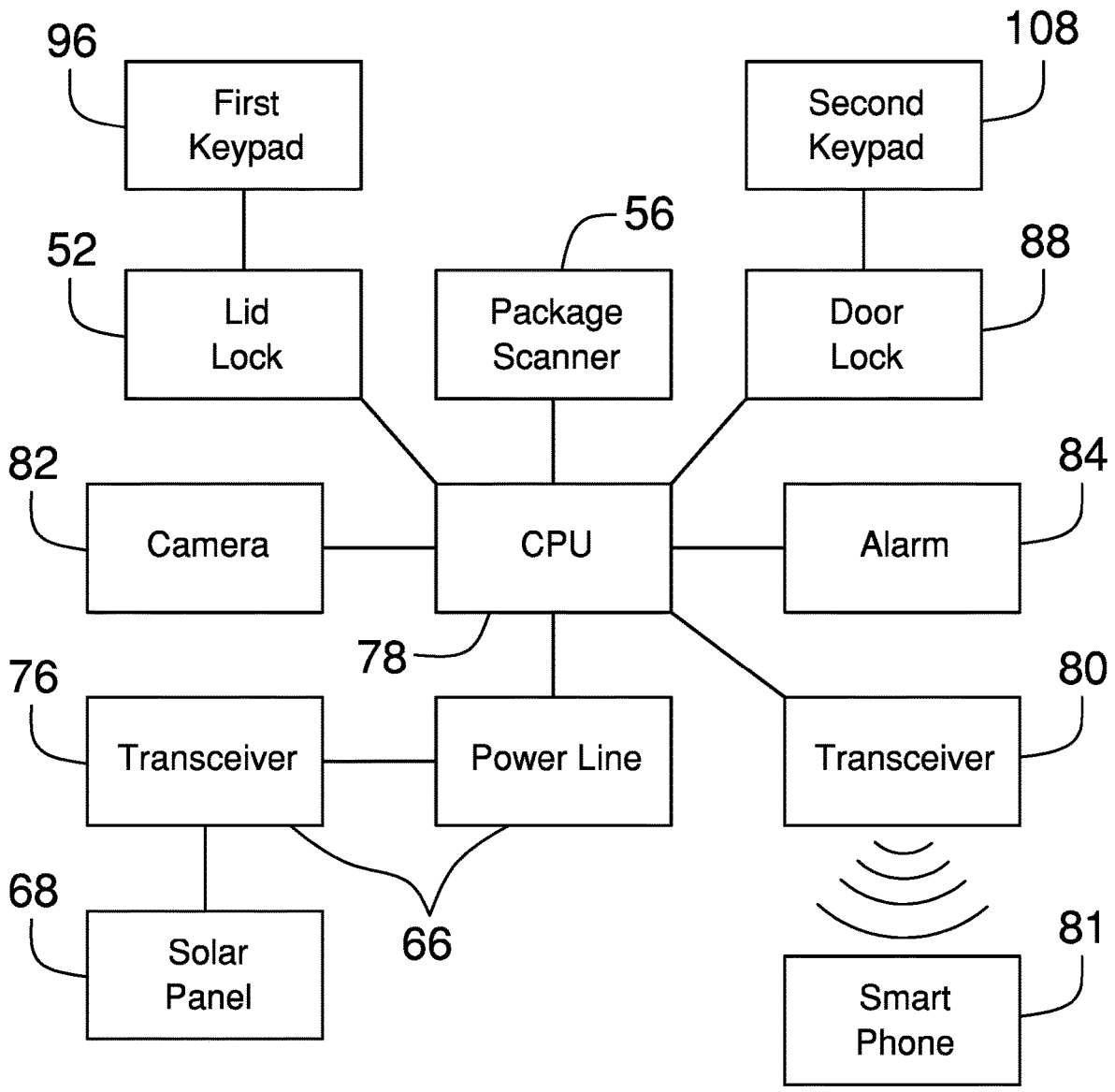
FIG. 7 is a block diagram of an embodiment of the disclosure.

With reference now to the drawings, and in particular to FIGS. 1 through 6 thereof, a new mailbox embodying the principles and concepts of an embodiment of the disclosure and generally designated by the reference numeral 10 will be described.

As best illustrated in FIGS. 1 through 6, the secure mail and package storage apparatus 10 generally comprises a package housing 12 that has a housing front side 14 separated from a housing back side 16, a housing left side 18 separated from a housing right side 20, and a housing bottom side 22 separated from an open housing top side 24 defining a storage cavity 26. An electrical box 28 is coupled to the housing left side 18. An insulation layer 30 is coupled to the package housing 12 within the storage cavity 26 to maintain temperature, particularly for packages containing food items. A plurality of ground screws 32 is coupled to the package housing 12 and is selectively engageable with the housing bottom side 22. The plurality of ground screws 32 is configured to secure the package housing 12 to the ground to prevent a thief from attempting to steal the apparatus 10. A lid 34 is coupled to the package housing 12. The lid 34 comprises a front half 36 coupled to the housing top side 24 adjacent the housing front side 14 and a back half 38 coupled to the housing top side 24 adjacent the housing back side 16. Each of the front half 36 and the back half 38 have a pair of flat side panels 40 and a rounded top panel 42. The side panel 40 of each of the front half 36 and the back half 38 adjacent the housing left side 18 has a lock aperture 44 extending therethrough. Each of the front half 36 and the back half 38 has a hinge 46 and is swingingly coupled to the package housing 12 to move between a closed position 48 sealing the storage cavity 26 and an alternate open position 50 exposing the storage cavity 26. The package housing 12 may be installed partially beneath ground level in order to minimize the visible profile.

The hinges 46 of each of the front half 36 and the back half 38 of the lid 34 are spring-loaded to allow the lid 34 to move automatically from the closed position 48 to the open position 50. A lid lock 52 is coupled to the housing left side 18 and extends above the housing top side 24. The lid lock 52 has a pair of pins 54 that is selectively engageable with the lock aperture 44 of the front half 36 and the back half 38. The lid lock 52 is in operational communication with the lid 34 to lock the lid 34 in the closed position 48 and alternatively unlock the lid 34 to allow it to move to the open position 50.

A CPU 56 is coupled to the housing right side 20 adjacent the housing front side 14 within the storage cavity 26. The CPU 56 is in operational communication with the lid lock 52. A package platform 58 is coupled to the package housing 12, and the package platform 58 has a pair of lift arms 60 coupled to the housing bottom side 22 within the storage cavity 26. A main platform 62 is coupled to the pair of lift arms 60, and a platform sensor 64 is coupled to the main platform 62. The platform sensor 64 is in operational communication with the pair of lift arms 60, a power source 66, and the CPU 56. The platform sensor 64 is configured to detect the presence of a package and to raise the main platform 62 when the lid 34 is opened.

A solar panel 68 is coupled to the lid 34 and has a support 70 coupled to the front half 36 and a plurality of solar cells 72 coupled to the support 70. The support 70 allows the plurality of solar cells 72 to lie horizontally to maximize solar absorption. The power source 66 is coupled to the CPU 56 and comprises a battery 76 coupled adjacent the CPU 56 and a powerline 78. The battery 76 is in operational communication with the solar panel 68. The powerline 78 extends through the electrical box 28 coupled to the package housing 12 to prevent tampering. A transceiver 80 is coupled to the CPU 56, and the transceiver 80 is configured to communicate with a smartphone 81. A camera 82 is coupled to the housing front side 14 and is in operational communication with the CPU 56 and the power source 66. An alarm 84 is coupled to the housing front side 14 and is in operational communication with the CPU 56 and the power source 66. The camera 82 and the alarm 84 are in operational communication with the smartphone. The smartphone can activate the alarm 84.

A first keypad 86 is coupled to the package housing 12. The first keypad 86 is coupled to the housing left side 18 and is in operational communication with the CPU 56 to engage, and alternatively disengage, the lid lock 52. A package scanner 87 may also be coupled to the lid 34 and in operational communication with the CPU 56. The package scanner 87 is configured to read a package label on a delivery to automatically disengage the lid lock 52 and open the lid 34. A mail tower 90 is coupled to the package housing 12. The mail tower 90 has a tower left side 92 separated from a tower right side 94, a tower front side 96 separated from a tower back side 98, and a tower bottom side 100 separated from a rounded tower top side 102. The tower front side 96 has a mail cavity 104 extending towards the tower back side 98. A mail door 106 is coupled to the mail tower 90, and the mail door 106 is swingingly coupled to the tower front side 96 to cover, and alternatively expose, the mail cavity 104. The mail door 106 has a door lock 88 that is in operational communication with the CPU 56. A second keypad 108 is coupled to the mail tower 90. The second keypad 108 is coupled to the tower front side 96 below the mail cavity 104 and is in operational communication with the CPU 56 to engage, and alternatively disengage, the door lock 88.

In use, the user's mail is securely received in the mail cavity 104 and packages are received within the storage cavity 26. The first keypad 86 and the second keypad 108 are used to open the lid 34 and the mail door 106, respectively. When the lid 34 is opened the package platform 58 automatically raises to make packages easier to access. The user may activate the alarm 84 and the camera 82 on the smartphone to monitor the mail received.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A secure mail and package storage apparatus comprising:

a package housing, the package housing having a housing front side separated from a housing back side, a housing left side separated from a housing right side, and a housing bottom side separated from an open housing top side defining a storage cavity;

a plurality of ground screws coupled to the package housing, the plurality of ground screws being selectively engageable with the housing bottom side and configured to secure the package housing to the ground;

a lid coupled to the package housing, the lid comprising a front half coupled to the housing top side adjacent the housing front side and a back half coupled to the housing top side adjacent the housing back side, each of the front half and the back half having a hinge and being swingingly coupled to the package housing to move between a closed position sealing the storage cavity and an alternate open position exposing the storage cavity;

a lid lock coupled to the package housing, the lid lock being coupled to the housing left side and extending above the housing top side, the lid lock being in operational communication with the lid to lock the lid in the closed position and alternatively unlock the lid to allow it to move to the open position;

a CPU coupled to the package housing, the CPU being coupled to the housing right side adjacent the housing front side, the CPU being in operational communication with the lid lock;

a power source coupled to the CPU, the power source being in operational communication with the CPU;

a transceiver coupled to the CPU, the transceiver being configured to communicate with a smartphone;

a first keypad coupled to the package housing, the first keypad being coupled to the housing left side and in operational communication with the CPU to lock and alternatively unlock the lid lock;

a mail tower coupled to the package housing, the mail tower having a tower left side separated from a tower right side, a tower front side separated from a tower back side, and a tower bottom side separated from a tower top side, the tower front side having a mail cavity extending towards the tower back side;

a mail door coupled to the mail tower, the mail door being swingingly coupled to the tower front side to cover, and alternatively expose, the mail cavity, the mail door having a door lock, the door lock being in operational communication with the CPU; and a second keypad coupled to the mail tower, the second keypad being coupled to the tower front side below the mail cavity and in operational communication with the CPU to lock and unlock the door lock.

2. The secure mail and package storage apparatus of claim 1 further comprising the tower top side and the lid being rounded, each of the front half and the back half of the lid having a pair of flat side panels and a rounded top panel.

3. The secure mail and package storage apparatus of claim 2 further comprising the side panel of each of the front half and the back half adjacent the housing left side having a lock aperture extending therethrough, the lid lock having a pair of pins, the pair of pins being selectively engageable with the lock aperture of the front half and the back half.

4. The secure mail and package storage apparatus of claim 1 further comprising an insulation layer coupled to the package housing, the insulation layer being coupled within the storage cavity.

5. The secure mail and package storage apparatus of claim 1 further comprising a solar panel coupled to the lid, the solar panel having a support coupled to the front half and a plurality of solar cells coupled to the support.

6. The secure mail and package storage apparatus of claim 5 further comprising the power source comprising a battery coupled adjacent the CPU and a powerline, the battery being in operational communication with the solar panel, the powerline extending through an electrical box coupled to the package housing.

7. The secure mail and package storage apparatus of claim 1 further comprising the hinges of each of the front half and the back half of the lid being spring-loaded, the lid moving automatically from closed position to the open position.

8. The secure mail and package storage apparatus of claim 1 further comprising a package platform coupled to the package housing, the package platform having a pair of lift arms coupled to the housing bottom side within the storage cavity, a main platform coupled to the pair of lift arms, and a platform sensor coupled to the main platform, the platform sensor being in operational communication with the pair of lift arms, the power source, and the CPU, the platform sensor being configured to detect the presence of a package and to raise the main platform when the lid is opened.

9. The secure mail and package storage apparatus of claim 1 further comprising a camera and an alarm coupled to the package housing, each of the camera and the alarm being coupled to the housing front side and being in operational communication with the CPU and the power source.

10. A secure mail and package storage apparatus comprising:

a package housing, the package housing having a housing front side separated from a housing back side, a housing left side separated from a housing right side, and a housing bottom side separated from an open housing top side defining a storage cavity;

an electrical box coupled to the package housing, the electrical box being coupled to the housing left side;

an insulation layer coupled to the package housing, the insulation layer being coupled within the storage cavity;

a plurality of ground screws coupled to the package housing, the plurality of ground screws being selectively engageable with the housing bottom side and configured to secure the package housing to the ground;

a lid coupled to the package housing, the lid comprising a front half coupled to the housing top side adjacent the housing front side and a back half coupled to the housing top side adjacent the housing back side, each of the front half and the back half having a pair of flat side panels and a rounded top panel, the side panel of each of the front half and the back half adjacent the housing left side having a lock aperture extending therethrough, each of the front half and the back half having a hinge and being swingingly coupled to the package housing to move between a closed position sealing the storage cavity and an alternate open position exposing the storage cavity, the hinges of each of the front half and the back half of the lid being spring-loaded, the lid moving automatically from closed position to the open position;

a lid lock coupled to the package housing, the lid lock being coupled to the housing left side and extending above the housing top side, the lid lock having a pair of pins, the pair of pins being selectively engageable with the lock aperture of the front half and the back half, the lid lock being in operational communication with the lid to lock the lid in the closed position and alternatively unlock the lid to allow it to move to the open position;

a CPU coupled to the package housing, the CPU being coupled to the housing right side adjacent the housing front side, the CPU being in operational communication with the lid lock;

a package platform coupled to the package housing, the package platform having a pair of lift arms coupled to the housing bottom side within the storage cavity, a main platform coupled to the pair of lift arms, and a platform sensor coupled to the main platform, the platform sensor being in operational communication with the pair of lift arms and the CPU, the platform sensor being configured to detect the presence of a package and to raise the main platform when the lid is opened;

a solar panel coupled to the lid, the solar panel having a support coupled to the front half and a plurality of solar cells coupled to the support;

a power source coupled to the CPU, the power source comprising a battery coupled adjacent the CPU and a powerline, the battery being in operational communication with the solar panel, the powerline extending through the electrical box coupled to the package housing, the power source being in operational communication with the package platform, the solar panel, and the CPU;

a transceiver coupled to the CPU, the transceiver being configured to communicate with a smartphone;

a camera coupled to the package housing, the camera being coupled to the housing front side and being in operational communication with the CPU and the power source;

an alarm coupled to the package housing, the alarm being coupled to the housing front side and being in operational communication with the CPU and the power source;

a first keypad coupled to the package housing, the first keypad being coupled to the housing left side and in operational communication with the CPU;

a mail tower coupled to the package housing, the mail tower having a tower left side separated from a tower right side, a tower front side separated from a tower back side, and a tower bottom side separated from a rounded tower top side, the tower front side having a mail cavity extending towards the tower back side;

a mail door coupled to the mail tower, the mail door being swingingly coupled to the tower front side to cover, and alternatively expose, the mail cavity, the mail door having a door lock, the door lock being in operational communication with the CPU; and a second keypad coupled to the mail tower, the second keypad being coupled to the tower front side below the mail cavity and in operational communication with the CPU.

* * * * *